US010119659B2

(12) United States Patent
Novin et al.

(10) Patent No.: US 10,119,659 B2
(45) Date of Patent: Nov. 6, 2018

(54) RETROFIT LED LAMP FIXTURES

(71) Applicant: On Site LED, San Jose, CA (US)

(72) Inventors: Eliah David Novin, San Jose, CA (US); Wade Earl Novin, Sherman Oaks, CA (US)

(73) Assignee: Novin Enterprises LLC, San Jose, CA (US)

( * ) Notice: Subject to any disclaimer, the term of this patent is extended or adjusted under 35 U.S.C. 154(b) by 230 days.

(21) Appl. No.: 15/081,581

(22) Filed: Mar. 25, 2016

(65) Prior Publication Data

US 2016/0281972 A1 Sep. 29, 2016

Related U.S. Application Data

(60) Provisional application No. 62/139,638, filed on Mar. 27, 2015.

(51) Int. Cl.

| | |
|---|---|
| ***F21V 29/70*** | (2015.01) |
| ***F21V 29/83*** | (2015.01) |
| ***F21K 9/233*** | (2016.01) |
| ***F21V 29/60*** | (2015.01) |
| *F21V 23/06* | (2006.01) |
| *F21V 23/00* | (2015.01) |
| *F21V 29/76* | (2015.01) |
| *F21Y 115/10* | (2016.01) |
| *F21K 9/238* | (2016.01) |

(52) U.S. Cl.

CPC ..... *F21K 9/233* (2016.08); *F21V 29/60* (2015.01); *F21K 9/238* (2016.08); *F21V 23/006* (2013.01); *F21V 23/06* (2013.01); *F21V 29/763* (2015.01); *F21Y 2115/10* (2016.08)

(58) Field of Classification Search

CPC ..... F21K 9/233; F21V 29/60

See application file for complete search history.

(56) References Cited

U.S. PATENT DOCUMENTS

2007/0147046 A1* 6/2007 Arik ..... F21V 29/02 362/294

* cited by examiner

*Primary Examiner* — Joseph L Williams

(74) *Attorney, Agent, or Firm* — Zheng Liu; Weintraub Tobin

(57) ABSTRACT

Various embodiments of a lamp fixture are disclosed. In some embodiments, one such device includes an LED array that includes one or more LEDs; a mounting plate having an opening with a predefined shape; a reflector mounted to the mounting plate; a heat sink; an active cooling element mounted to the mounting plate; a power supply circuit board assembly for providing power to the device; a fixture connector plug; a rear enclosure; and an interface connector that electronically connects a power supply to the LED array. The heat sink is supported by the mounting plate.

21 Claims, 23 Drawing Sheets

Constant Current Power Supply

Input EMI Filter

Multi-LED Current Divider

Fan Power Supply
with bleeder circuit

Thermal Cutoff

RETROFIT LED LAMP FIXTURES

CROSS REFERENCE TO RELATED APPLICATIONS

This application claims priority to U.S. Provisional Application No. 62/139,638, filed Mar. 27, 2015, entitled "retrofit LED lamp for fixtures" which is hereby incorporated by reference in its entirety.

TECHNICAL FIELD

The present disclosure relates generally to Light Emitting Diodes (LED) retrofit lighting and more specifically to a platform for new fixtures as well as a solution for existing fixtures by replacing conventional light bulbs with LED lamps.

BACKGROUND

In the pursuit of energy efficiency, LED based lighting products are rapidly replacing incandescent and filament based light bulbs, among others. There is currently no structurally suitable LED replacement for the standard Par64 and Par56 light bulbs most widely used in entertainment venues, studios and sets, theaters, concert halls and convention centers. The current bulbs installed in many fixtures are energy inefficient, have a short lifespan and generate significant waste heat. While substitute LED lamps are available for lighting fixtures for other applications, such as the home or office, few exist for the "work horse" fixture in the professional lighting market. There is no structurally suitable LED lamp for standard fixtures that use Par56 and Par64 conventional bulbs.

Figure 1:
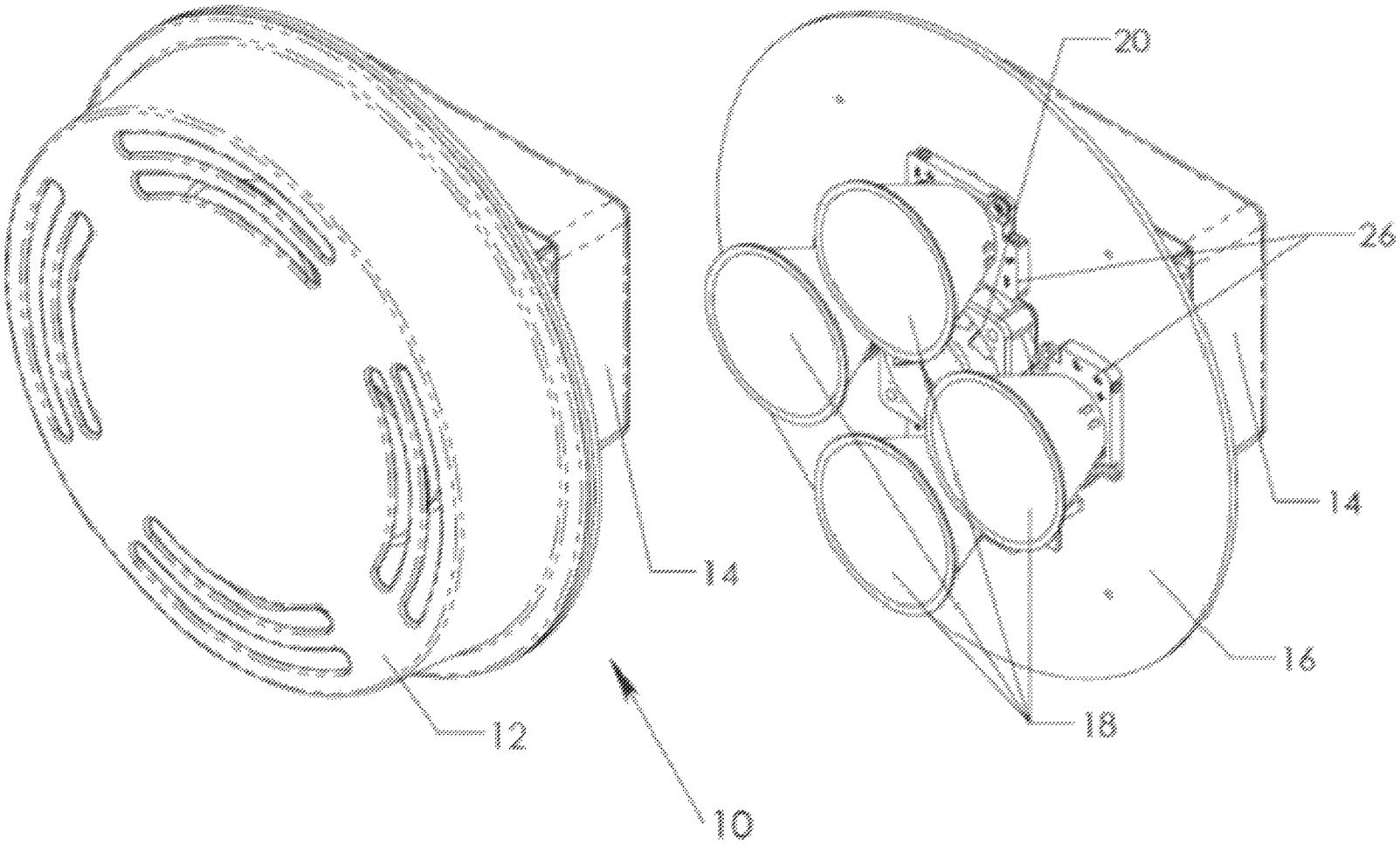
FIG. 1 is a perspective view of one embodiment of the present invention in a four LED, center mounted fan arrangement with a vented front cover shown both on and off for interior layout view.
Figure 2:
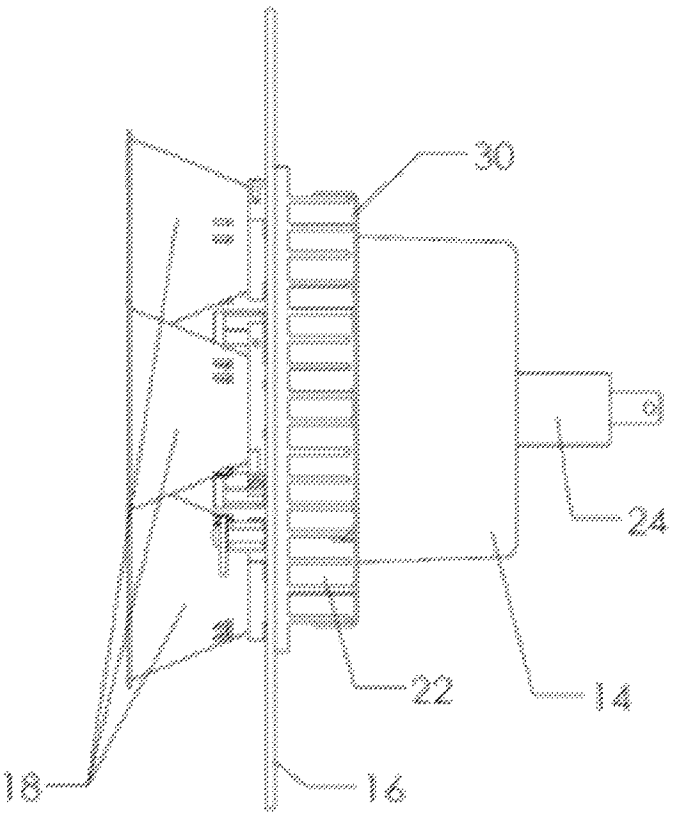
FIG. 2 is a front view and side view of the four LED, center mounted fan layout, with the front cover removed, in accordance with one embodiment.
Figure 2:
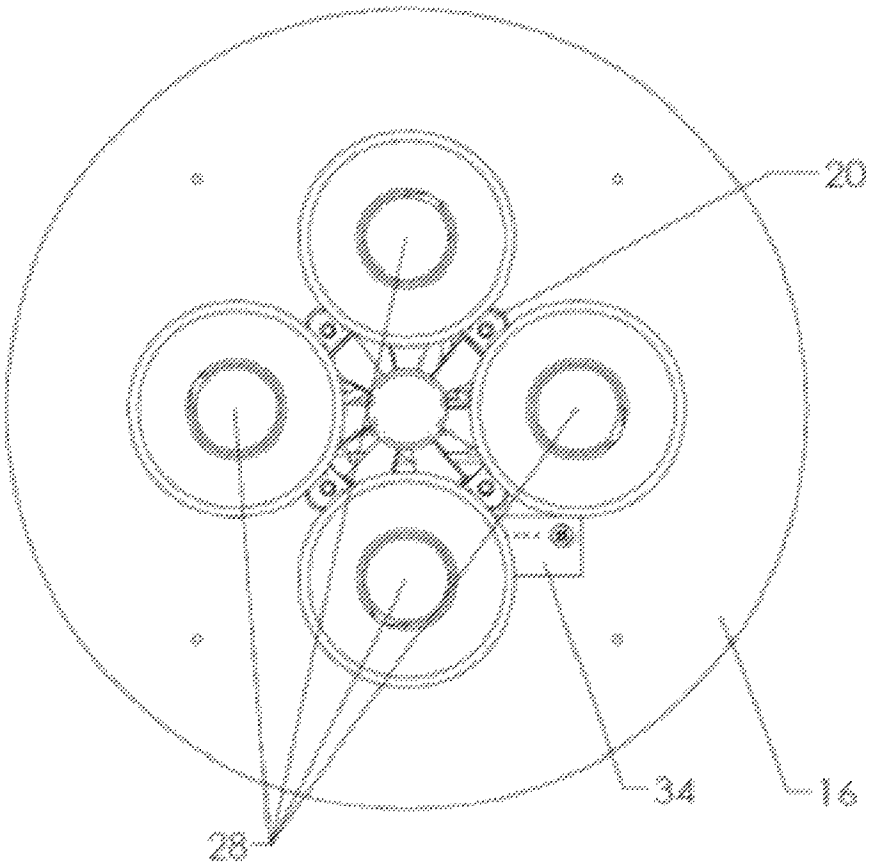
Figure 3:
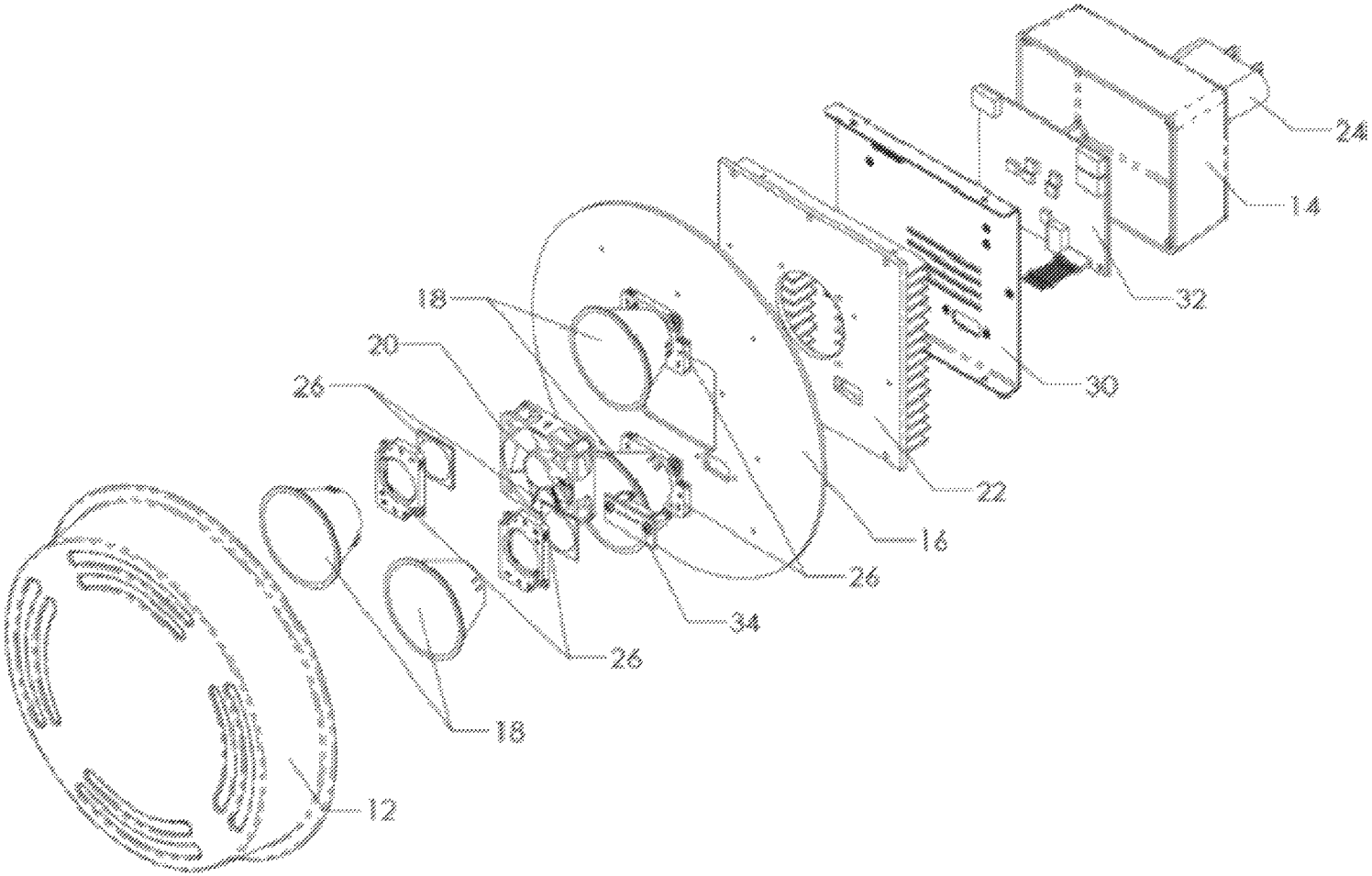
FIG. 3 is an exploded perspective view of the four LED, center mounted fan layout, in accordance with one embodiment.
Figure 4:
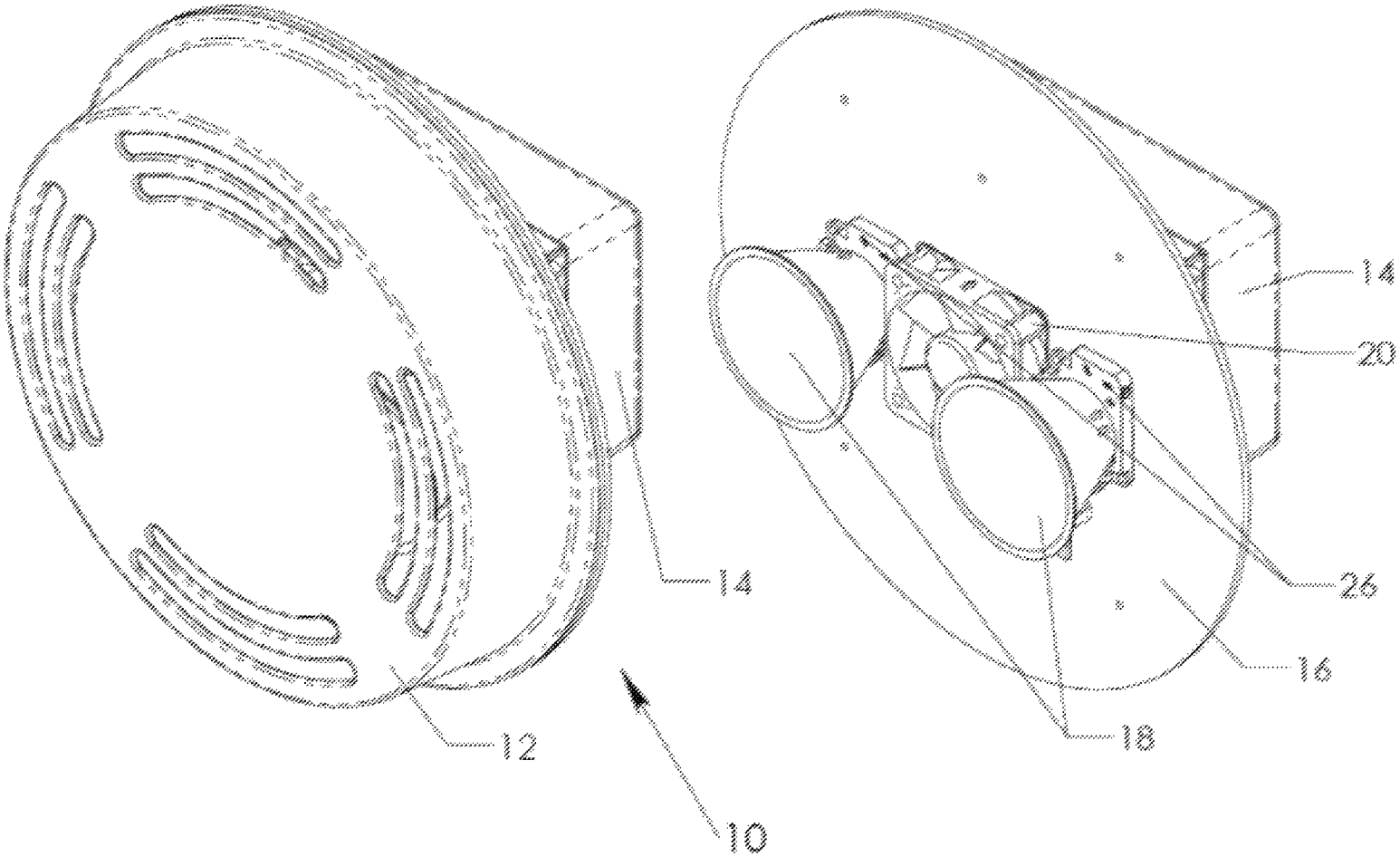
FIG. 4 is a perspective view of one embodiment of the present invention in a two LED, center mounted fan arrangement with a vented front cover shown both on and off for interior layout view.
Figure 5:
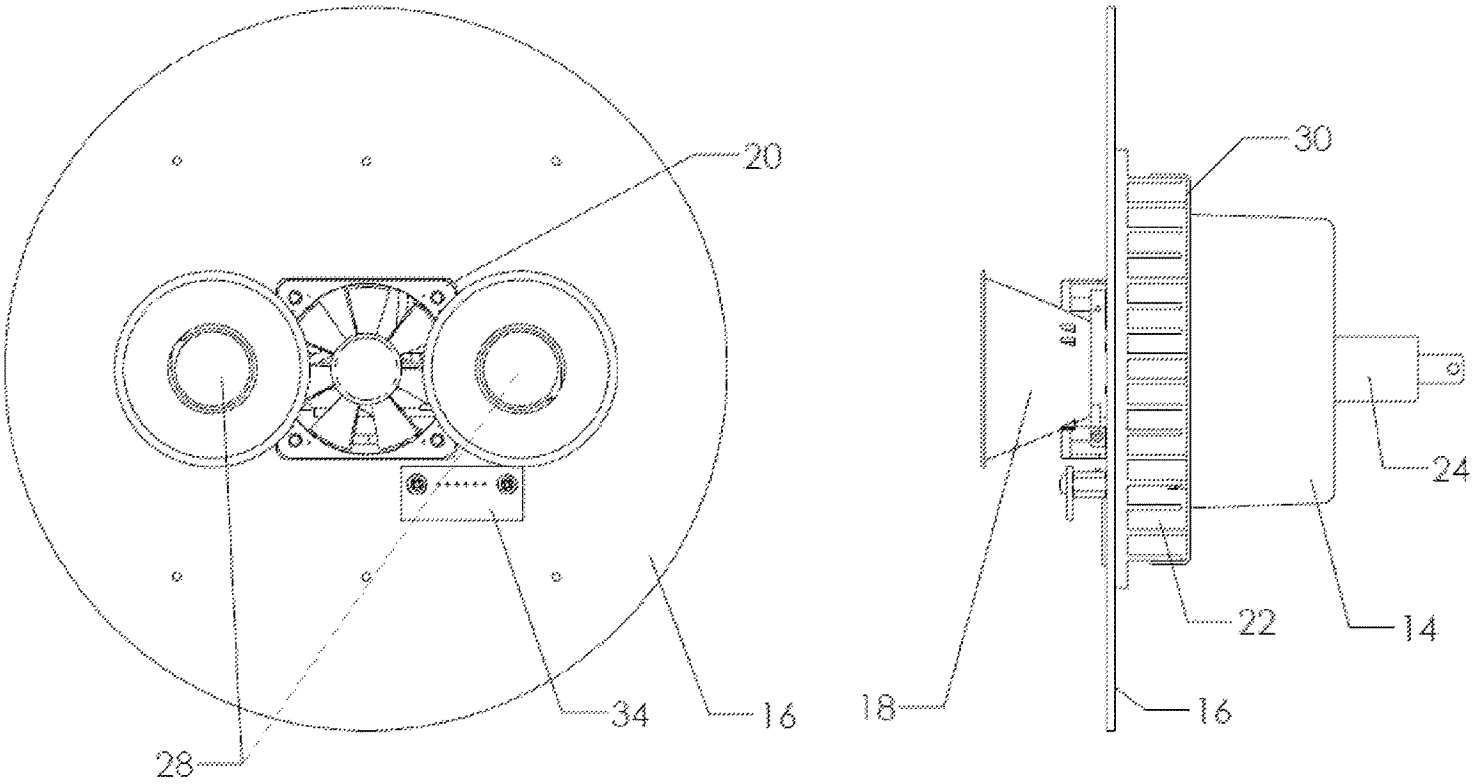
FIG. 5 is a front view and side view of the two LED, center mounted fan layout, with the front cover removed, in accordance with one embodiment.
Figure 6:
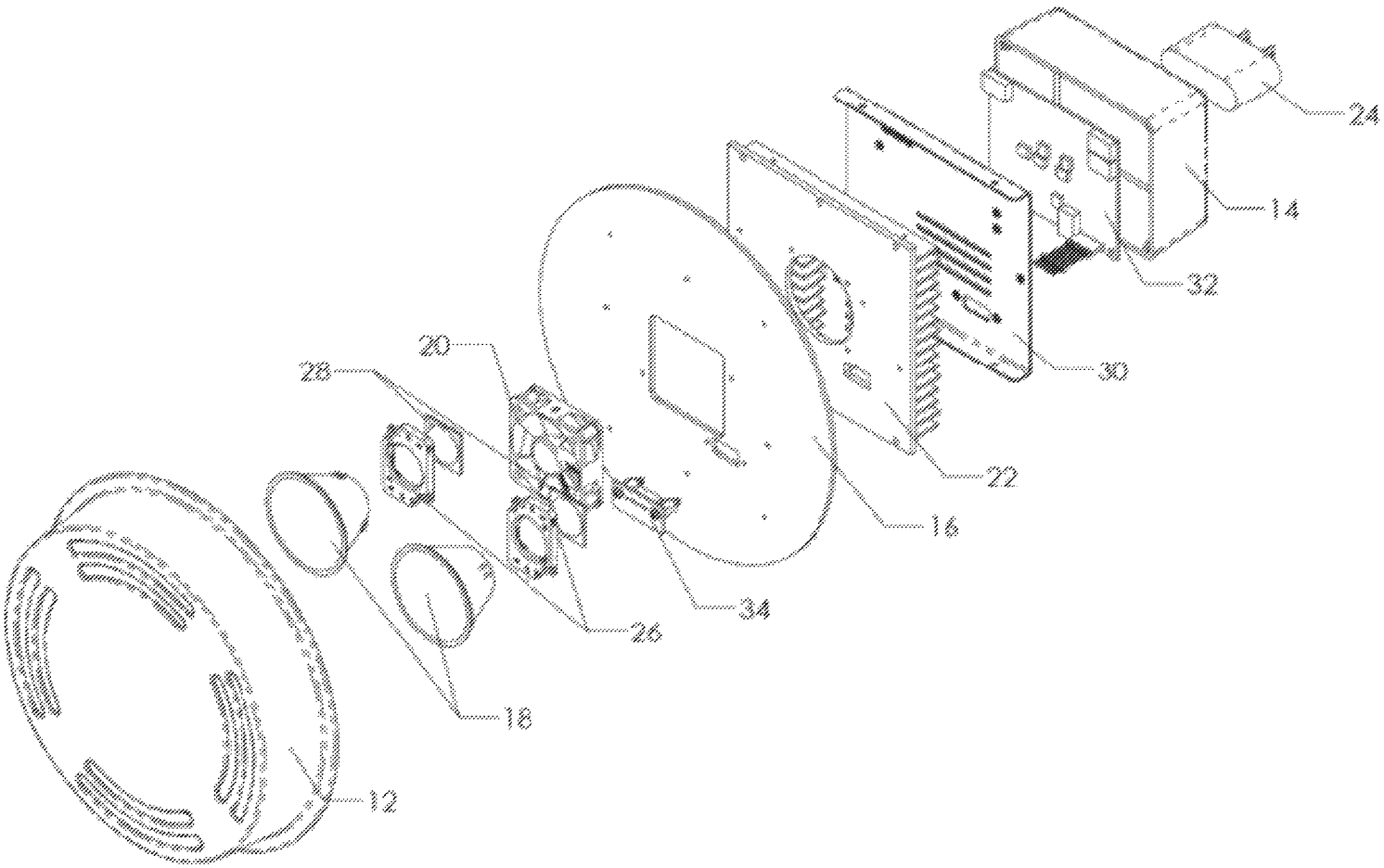
FIG. 6 is an exploded perspective view of the two LED, center mounted fan layout, in accordance with one embodiment.
Figure 7:
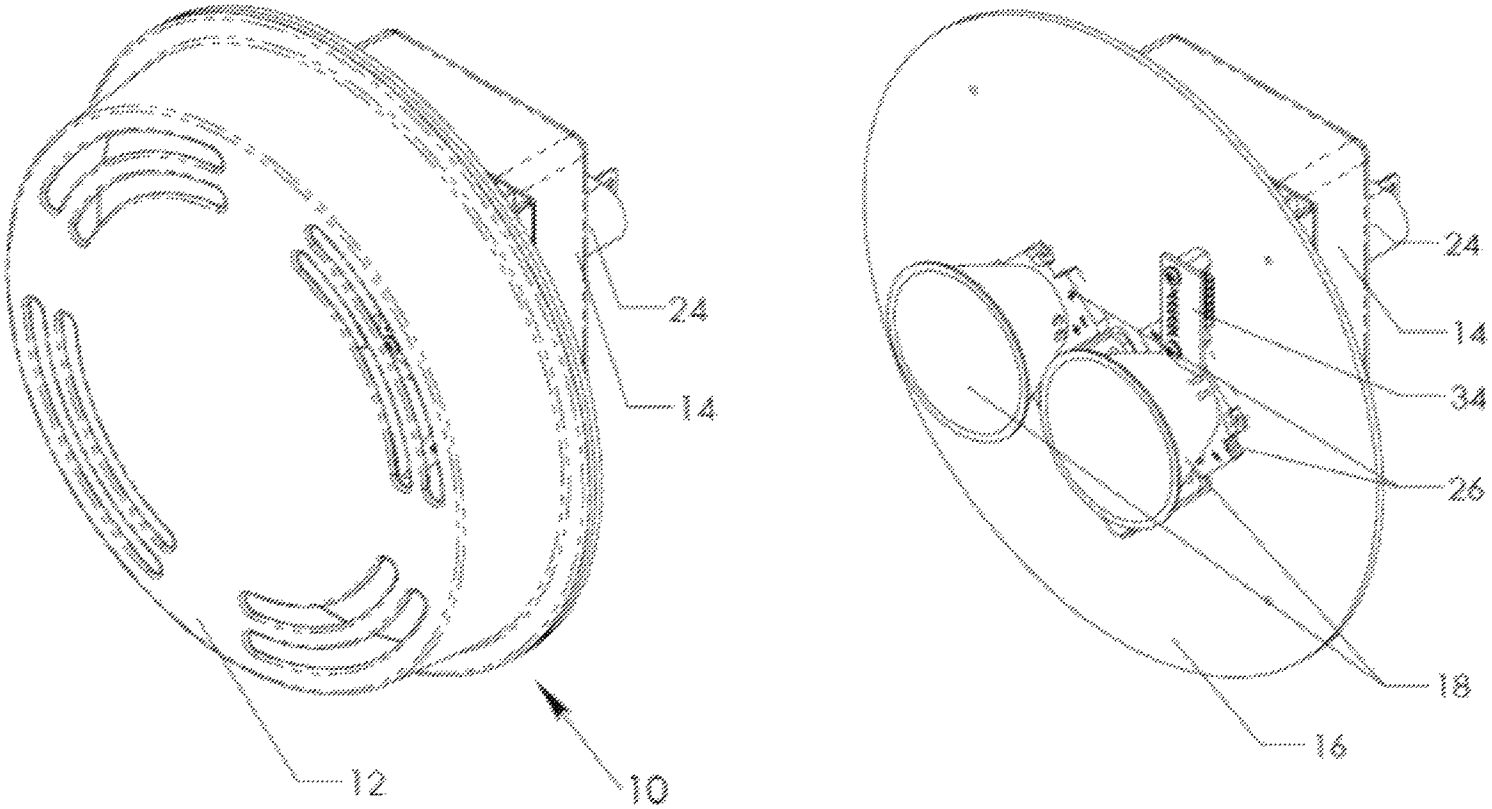
FIG. 7 is a perspective view of one embodiment of the present invention in a two LED, offset mounted fan arrangement with a vented front cover shown both on and off for interior layout view.
Figure 8:
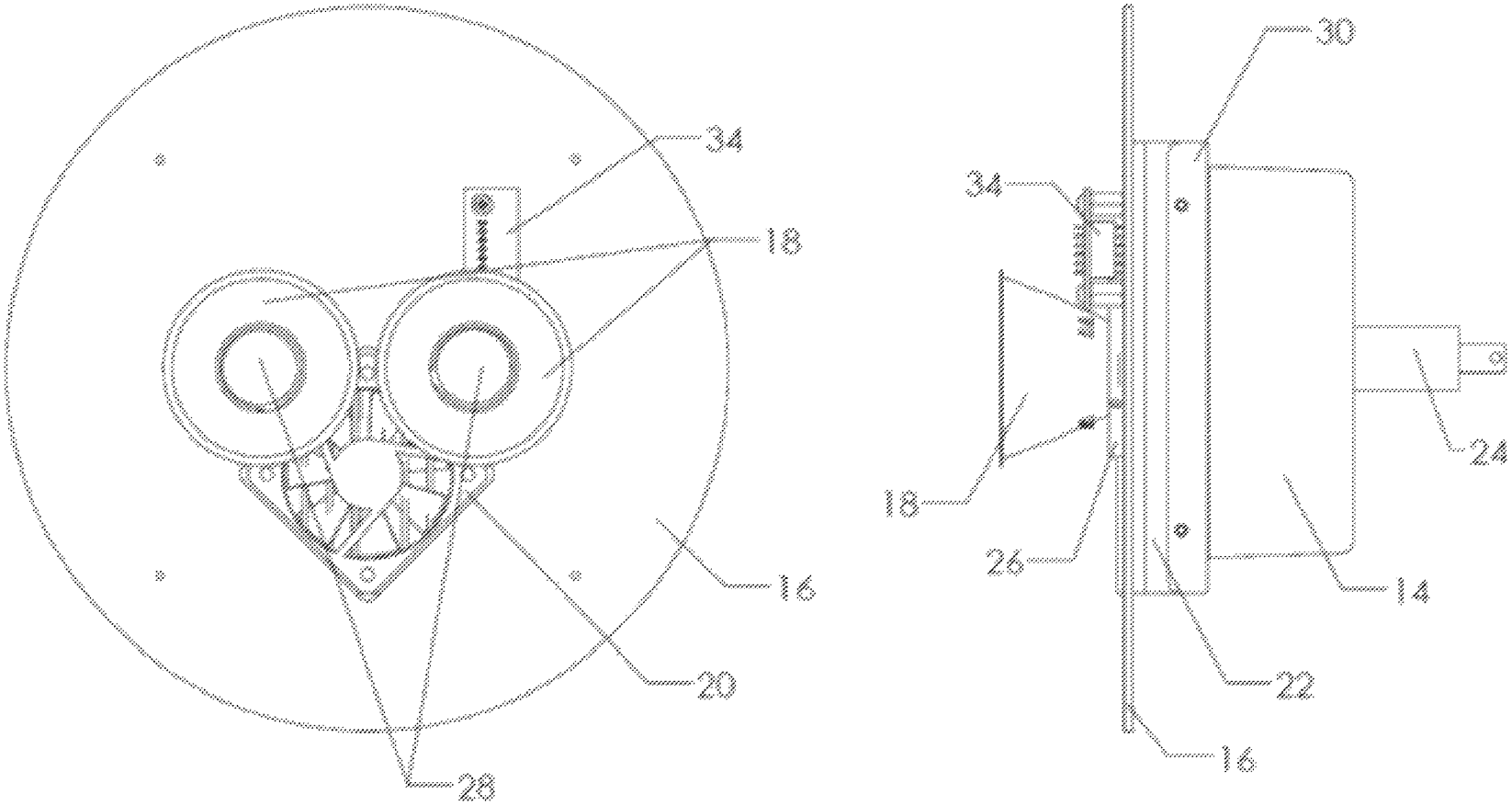
FIG. 8 is a front view and side view of the two LED, offset mounted fan layout, with the front cover removed, in accordance with one embodiment.
Figure 9:
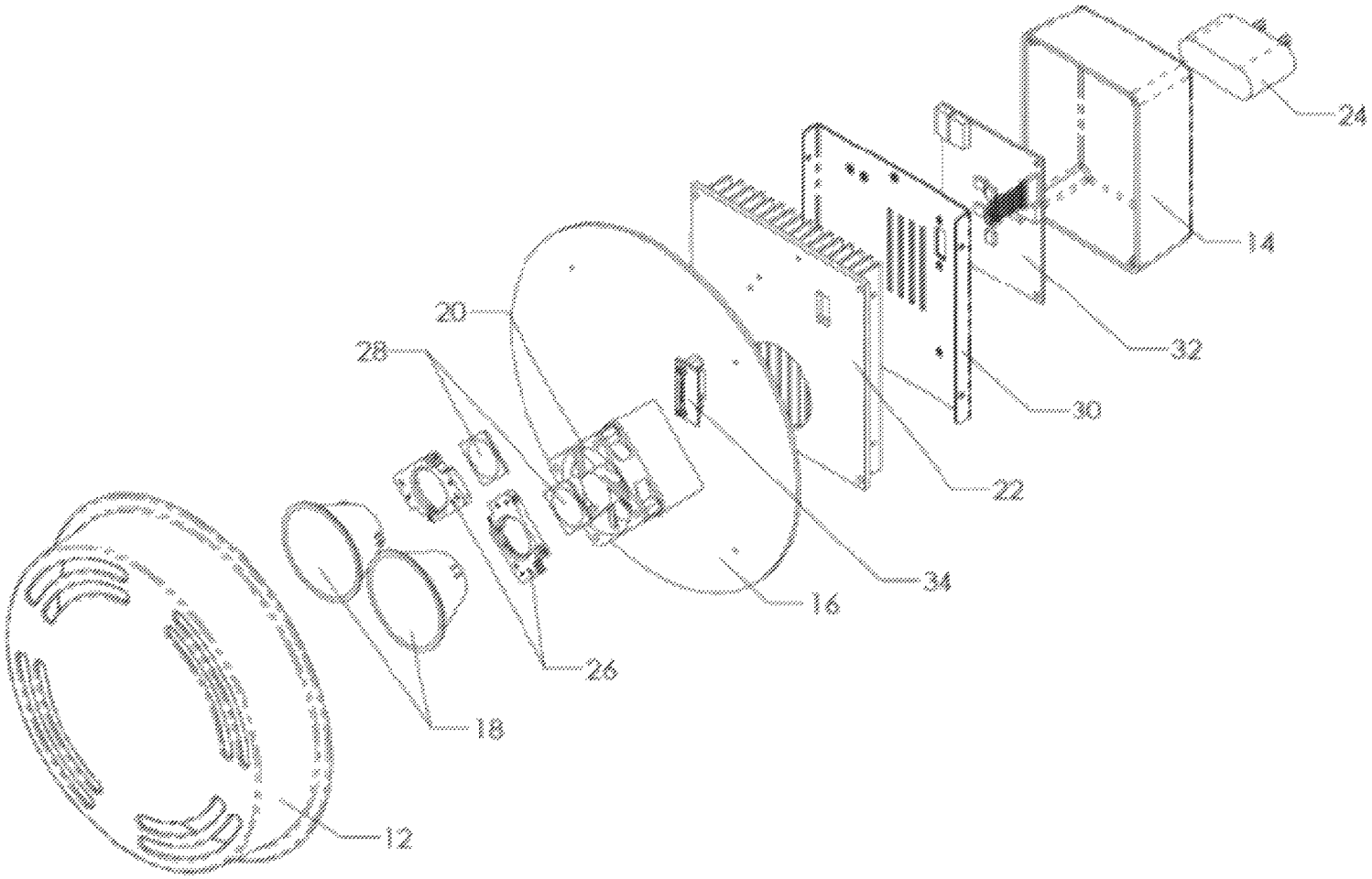
FIG. 9 is an exploded perspective view of the two LED, offset mounted fan layout, in accordance with one embodiment.

Item 10 represents a LED retrofit lamp system. Item 12 represents a front cover, e.g., vented. Item 14 represents a rear enclosure. Item 16 represents a mounting plate. Item 18 represents LED optics. Item 20 represents a cooling element. Item 22 represents a heat sink. Item 24 represents a fixture connector plug. Item 26 represents an LED holder. Item 28 represents an LED array. Item 30 represents a heat sink shroud. Item 32 represents a power supply circuit board assembly. Item 34 represents an interface connector board assembly. Item 45 represents an AC power input. Item 50 represents a passive in rush limiter. Item 55 represents an EMI filter 2/4 pole. Item 60 represents a filter dampening active and passive component. Item 62 represents a fan power supply. Item 65 represents a passive bleeder. Item 70 represents a rectifier bridge. Item 75 represents a secondary filter and dampener. Item 80 represents an active bleeder. Item 82 represents an antenna. Item 83 represents a radio transceiver. Item 84 represents a data collection unit. Item 85 represents an energy storage. Item 95 represents a buck SMPS.

In the drawings, elements having the same reference numbers have the same or similar functions.

DETAILED DESCRIPTION

In the following description specific details are set forth describing certain embodiments. It will be apparent, however, to one skilled in the art that the disclosed embodiments may be practiced without some or all of these specific details. The disclosed embodiments are meant to be illustrative, but not limiting. One skilled in the art may realize other material that, although not specifically described herein, is within the scope and spirit of the present disclosure.

The disclosed embodiments can address the undesirable qualities related to the use of conventional bulbs. Conventional bulbs are high in energy consumption due to their inefficiency. Further, conventional bulbs generate a significant amount of heat that radiates from the bulb. This can damage filtering gel sheets affixed to the fixture opening that are used to produce a monochromatic color other than white. This heat is often sufficient to make the fixture untouchable during operation and may also increase building energy costs used for ambient air conditioning. These conventional bulbs may also radiate some light through the back of the fixture causing undesirable effects when, as is often the case, light pattern control is necessary.

A suitable LED based replacement lamp can fit into existing fixtures and work with existing lighting control equipment without requiring any changes to wiring. The light pattern, dimming response and color temperatures can be similar to those produced by the conventional bulb. In some embodiments, the light pattern, dimming response and color temperatures may not be perceived by a user as visually distinguishable from the conventional bulb.

Similarly, a hybrid or new platform of lighting fixtures can be based on a LED solution. In a hybrid arrangement, conventional bulbs may be replaced with LED lamps and new additional fixtures may use a LED-only lamp. In a new platform, the invention fits into a fixture designed to house it and allow it to be used as in the same manner, for example as the Par64 and Par56 fixtures. It furnishes an equivalent adjustable yoke, base and connectivity for an LED PAR, which can be any embodiment of the device (e.g., lamp fixture) disclosed on the present disclosure.

Some disclosed embodiments provide an LED component based retrofit lamp for conventional bulbs used in associated fixtures that, when installed, require little or no modification to the fixture. Some disclose embodiments are compatible with existing wiring and power connections as well as lighting control and dimming equipment while achieving equivalent light output and color temperature. For example, in one embodiment, the conventional bulbs that are replaced are Par64 and Par56 bulbs.

In addition, some disclosed embodiments can be fully compatible with existing infrastructure and fixtures or may embody new fixtures. For example, in one embodiment, the invention can be installed into standard Par64 and Par56 fixtures. Alternatively, in another embodiment, the invention can be the core of a new fixture. This embodiment can be functional with existing infrastructure such as control equipment and wiring and may require minimal changes or upgrades to these set-ups.

In retrofit form, the form factor and package of some disclosed embodiments fits in the same space as the conventional bulb it replaces and installs in a similar manner. The entire LED PAR is designed to be compatible with standard, commercially available fixtures that were originally designed to accept conventional bulbs, such as incandescent bulbs. Different embodiments of the present invention correspond to various sizes, such as the 8 inch, Par64 size or the 7 inch, Par56 size. In one embodiment, this is achieved using a solid 8 inch or 7 inch diameter plate. As an additional benefit the use of a plate minimizes light leakage including the light produced from the LED element that would otherwise radiate out of the back of the lighting package. The electrical connection to the LED PAR is compatible with current industry standard plugs. In some embodiments, the electrical connection to the LED PAR is compatible with the same power provided to the conventional bulb it replaces with no change to voltage levels, phase or frequency.

The LED PAR may be cooled with forced convection and a suitable heat sink. For example, in one embodiment, air is passed over the heat sink drawn from the front of the fixture and exhausted out the back by a fan. This creates an efficient pass-through cooling method.

The LED PAR, in some embodiments, is equipped with network software and hardware that supports remote network services and allows for remote connectivity. In some embodiments, the LED PAR runs network services that allow a user to monitor and control the device. Monitoring services may include the ability to monitor service hours, current temperature, maximum temperature level reached and other pertinent status information. This information may be transmitted wirelessly using a network protocol such as IP, RFID, HTTP, HTTPS or other suitable network protocol for remote monitoring and logging.

The form factor of the package may allow for a field-replaceable power supply unit, separable from the other components. This can increase the useful lifetime of the LED components, heat sink and cooling elements. In some embodiments, forms are designed so that the LED PAR fits into the fixture in a similar manner as the conventional bulb it replaces.

Figure 13:
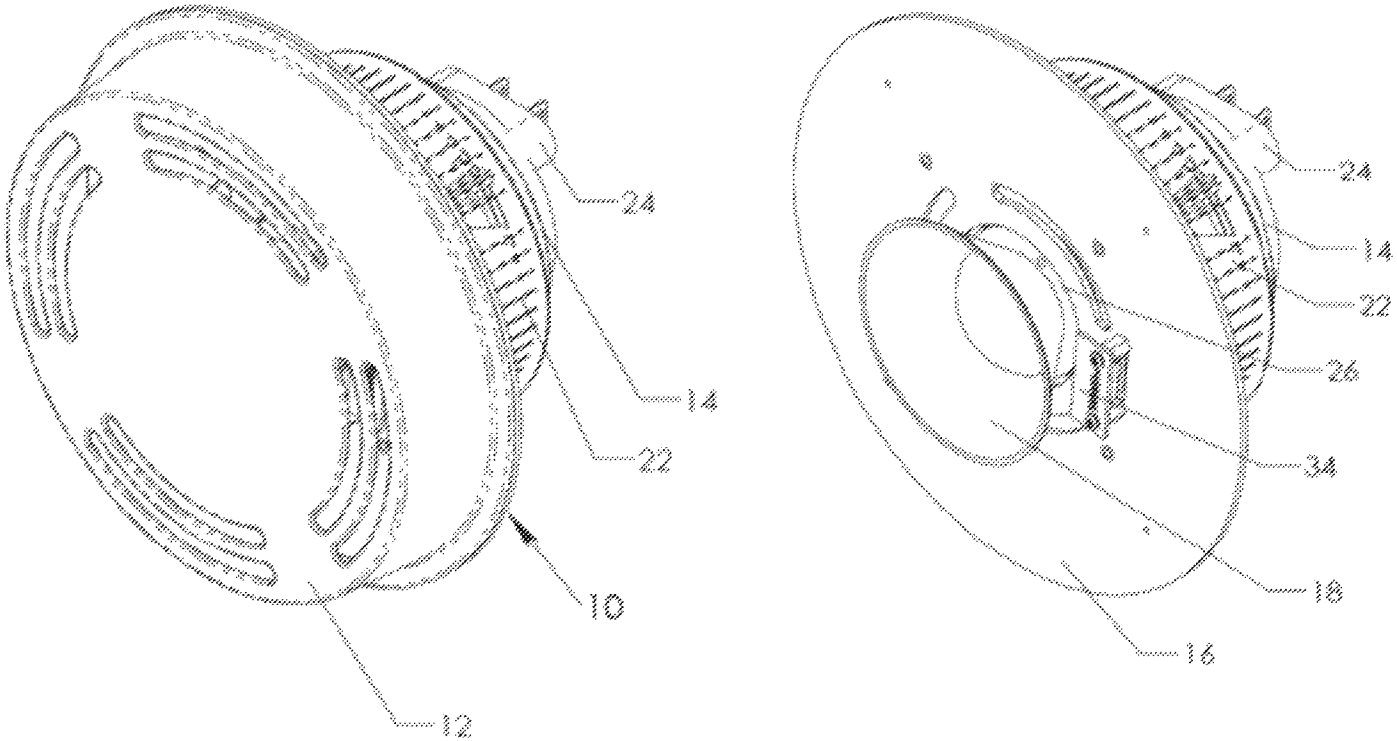
FIG. 13 is a perspective view of one embodiment of the present invention in a single LED, rear mounted fan, radial heat sink arrangement with a vented front cover shown both on and off for interior layout view.
Figure 14:
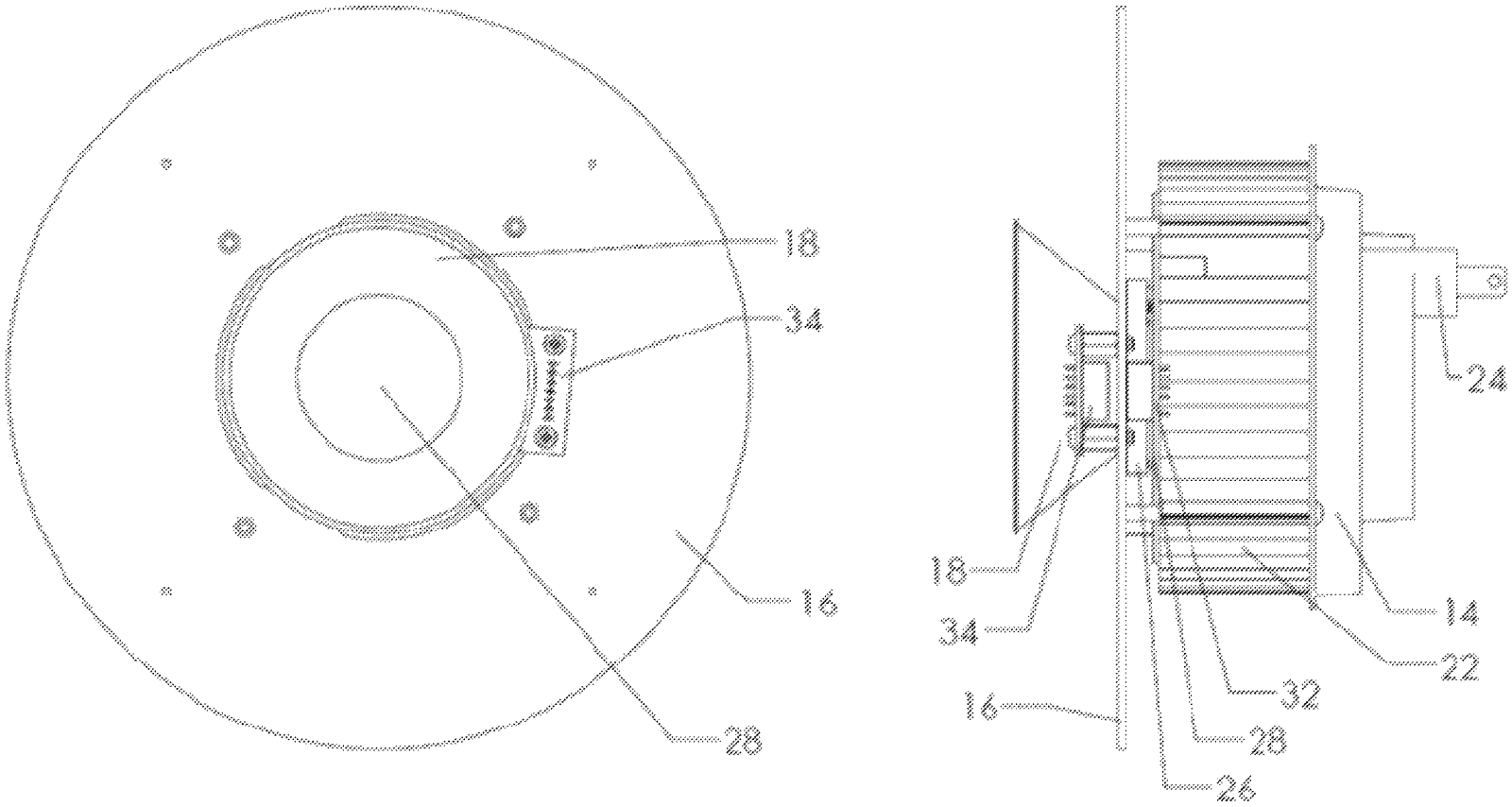
FIG. 14 is a front view and side view of the single LED, rear mounted fan, radial heat sink layout, with the front cover removed, in accordance with one embodiment.
Figure 15:
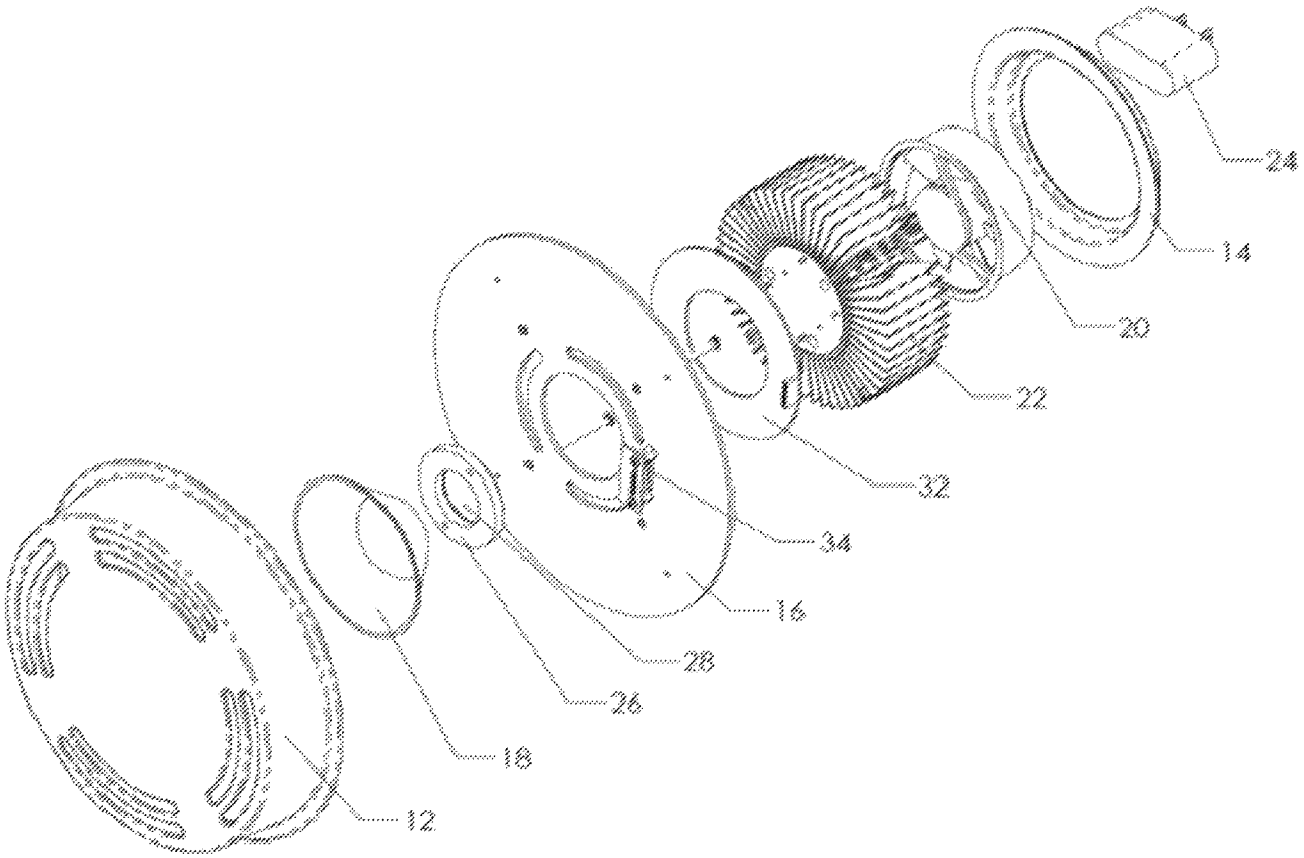
FIG. 15 is an exploded perspective view of the single LED, rear mounted fan, radial heat sink layout, in accordance with one embodiment.
Figure 16:
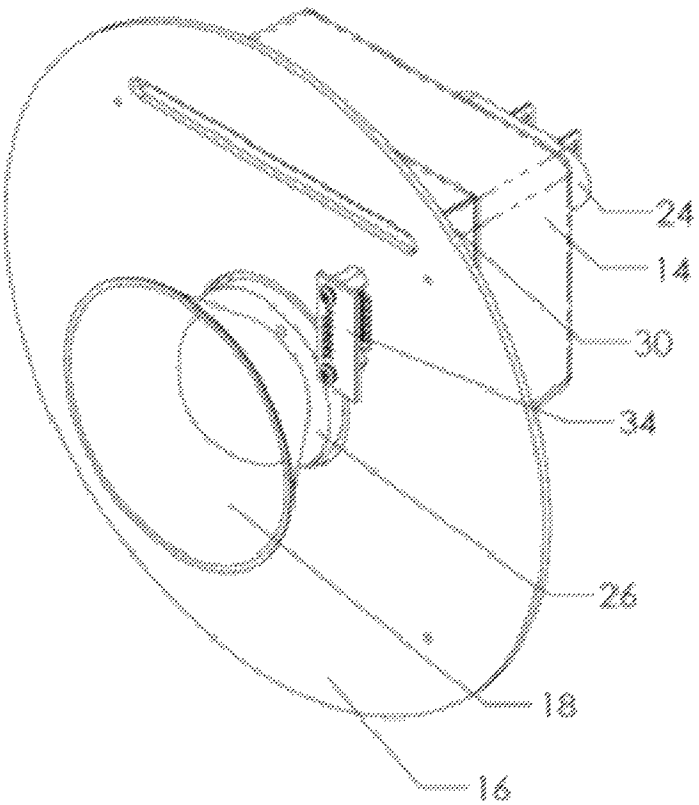
FIG. 16 is a perspective view of one embodiment of the present invention in a single LED, rear mounted fan, linear heat sink arrangement with a vented front cover shown both on and off for interior layout view.
Figure 16:
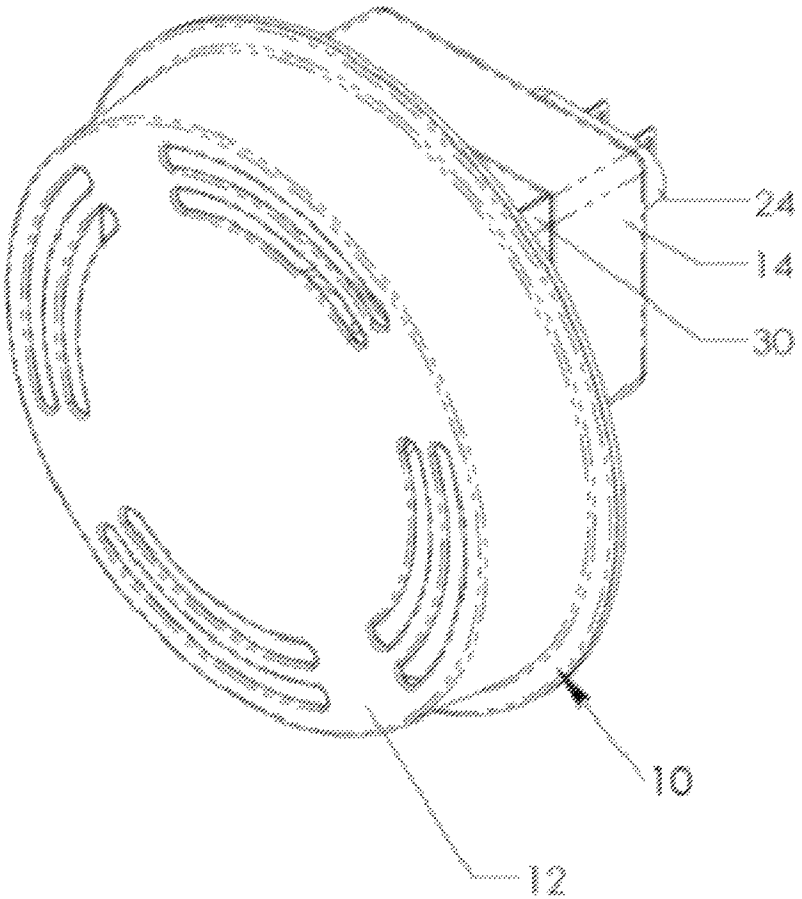
Figure 17:
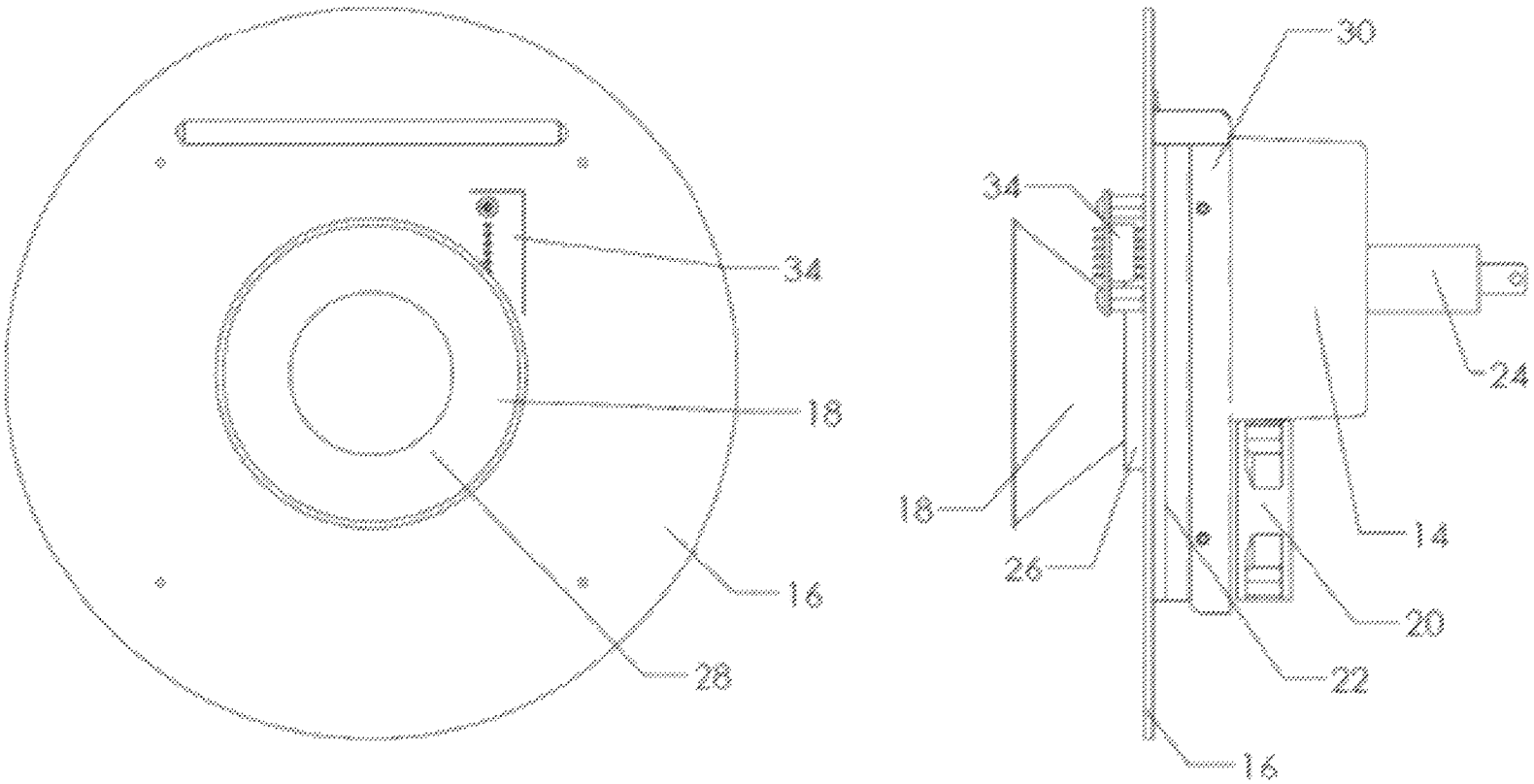
FIG. 17 is a front view and side view of the single LED, rear mounted fan, linear heat sink layout, with the front cover removed, in accordance with one embodiment.
Figure 18:
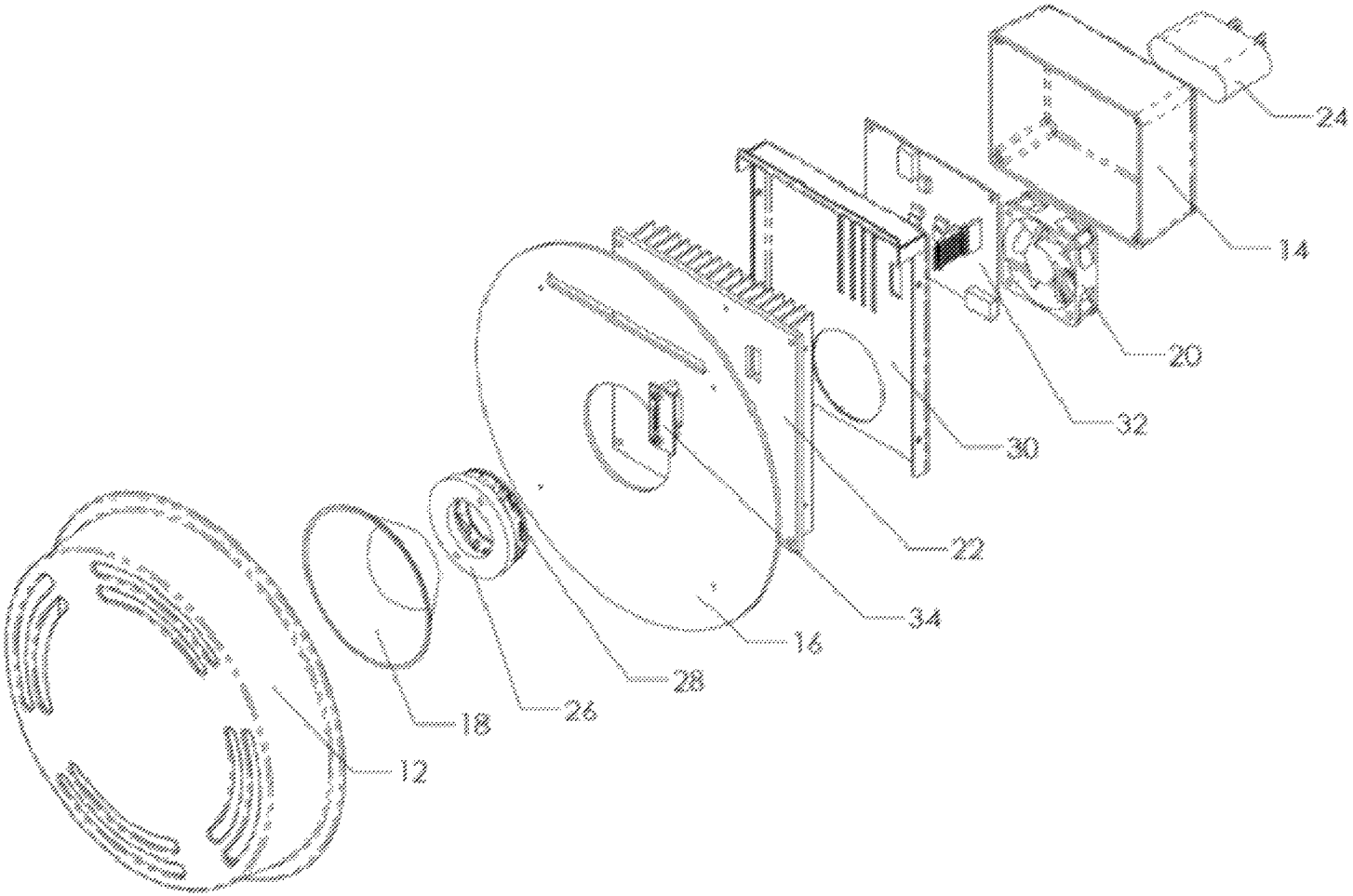
FIG. 18 is an exploded perspective view of the single LED, rear mounted fan, linear heat sink layout, in accordance with one embodiment.

In some embodiments, the LED PAR provides a mounting surface 16 for high powered LED emitter arrays 28 in a single, dual or quad configuration. FIGS. 1 through 18, as previously described and provided below, detail various embodiments of layouts, component arrangements and cooling solutions. Each design layout may be different to provide the range of light outputs the LED PAR is designed to achieve for market expectations. The mounting plate 16 may come in two distinct sizes, a 7-inch and an 8-inch diameter of stamped or cut aluminum for the purposes of heat sinking. In some embodiments, the LED arrays 28 are attached directly to this plate using holders 26 providing maximum thermal transmission. In another embodiment the form factor utilizes a plastic plate of the same two diameters. Other variations, e.g. as shown in FIG. 13 and FIG. 16, leave a cutout in the plate wherein the LED arrays may be installed directly to a heat sink.

In some embodiments, the LED PAR utilizes a heat sink 22. In one embodiment, the heat sink is a linear straight fin heat sink (e.g. 22 in FIG. 3), which is either machined, extruded, die cast, cold forged or made from bonded fins or folded fins. In another embodiment, the heat sink is of a radial design (e.g. 22 in FIG. 3) that is either machined, die cast, or cold forged. This part is manufactured from various combinations of aluminum, aluminum alloys, copper and other materials as dictated by design optimization.

A cooling element 20 may be utilized in any embodiment to provide cooling over the heat sink. In the various form factors, the pathway of air is such that air is either drawn from the front of the fixture and exhausted out the back or drawn in from the back and expelled through the front. Either configuration separates the inflow air and the outflow air which carries excess heat energy away from the LED arrays and power supply assembly. In some embodiments, a shroud 30 may be present to direct airflow over the heat sink. Passive cooling or other types of active cooling may be used in any embodiment of the LED PAR. For example, passive cooling can be, but is not limited to, a heat sink with a predefined shape.

Figure 19:
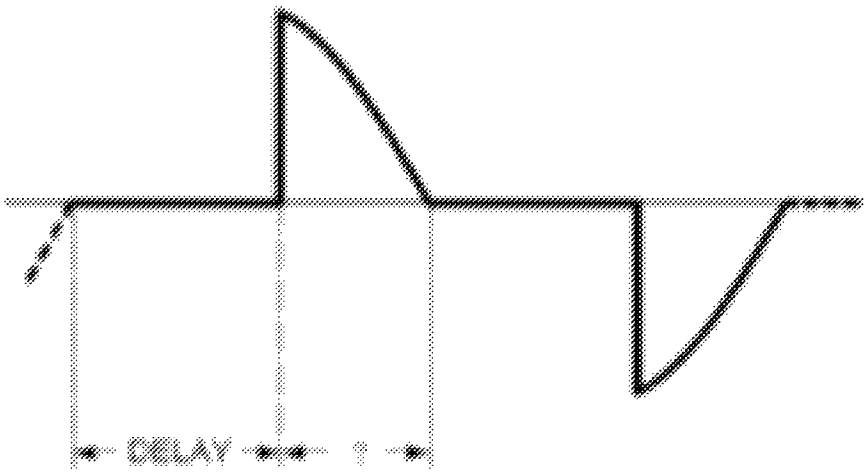
FIG. 19 is a diagram of delayed application of mains power when dimming

In some embodiments, the power supply is designed for compatibility with legacy lighting control equipment. Legacy dimming methods designed for conventional bulbs use various techniques to delay the application of power during every half cycle of mains power as shown in FIG. 19. Increasing the delay can reduce light output as the RMS power through the filament is reduced. Controlling switching devices, such as a Triac, SCR or IGBT, can facilitate this delay.

Figure 20:
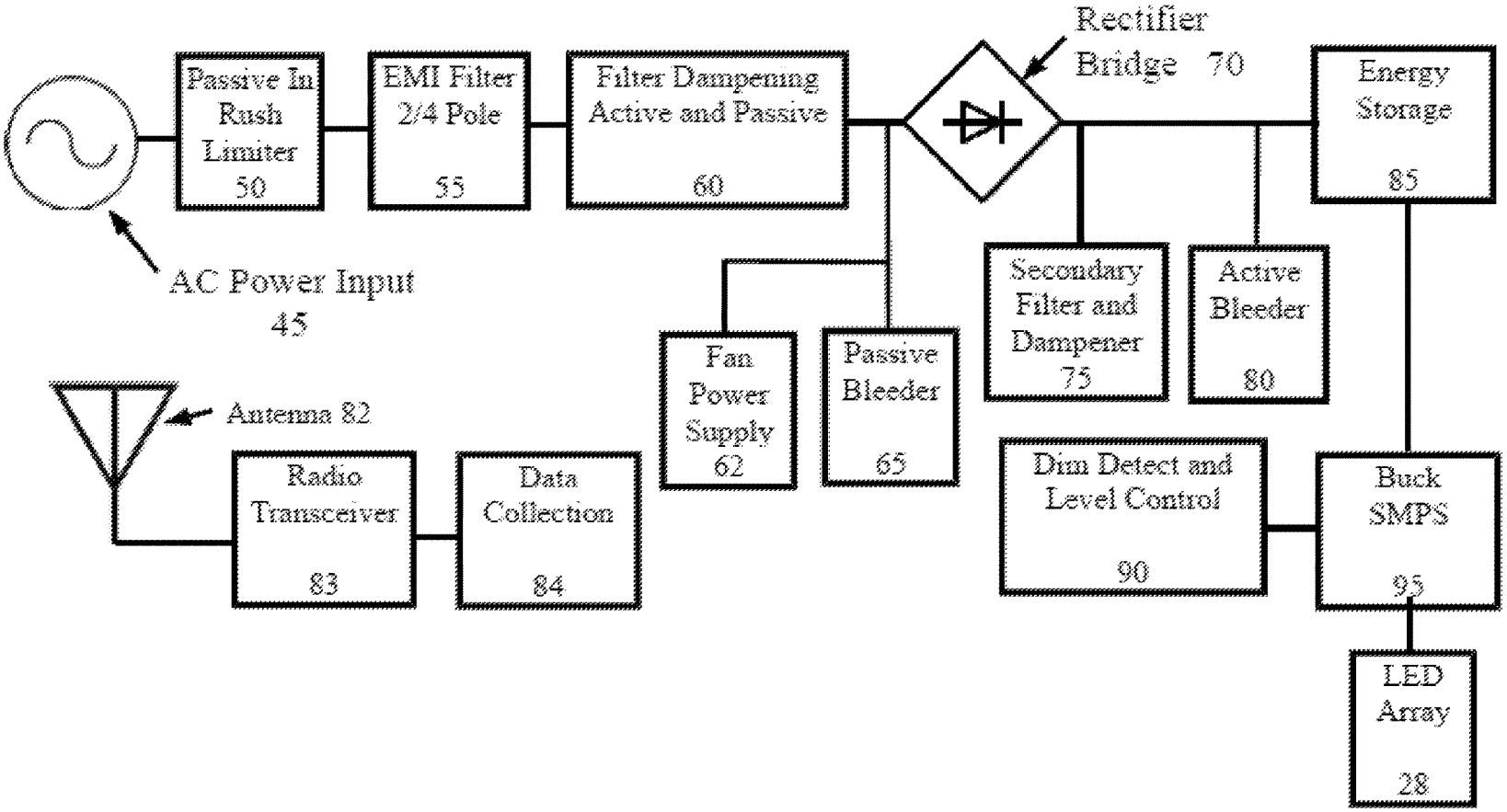
FIG. 20 is a block diagram of an example embodiment of the power supply.

A power supply, as shown in the embodiments disclosed in FIG. 20, delivers a constant current source to the LED elements. This current level is dependent on the time during the half cycle of mains power that is applied to the system. This time, or conduction time, is detected and converted by a dim detection and level control circuit 90 to replicate the dimming behavior of a conventional bulb. For example, in one embodiment, the LED PAR utilizes a Texas Instruments LM3445 or LM3450 driver integrated circuit, a Fairchild FL7730, an ON Semiconductor NCL30000, a Power Integrations LinkSwitch-PH device, a Maxim MAX16841 or any suitable commercially available off-line triac dimmable driver integrated circuit. One embodiment uses a microcontroller for detection and level control. The circuit design embodies state of the art technology and specific components references herein are not a limitation to any embodiment of the design.

Figure 23:
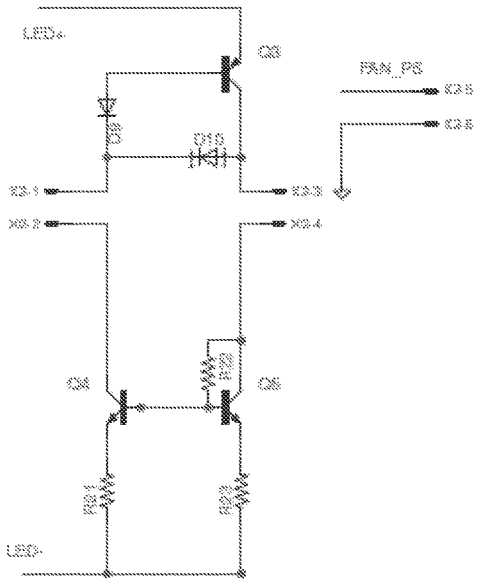

The power supply is an isolated or non-isolated switching mode buck regulator 95 delivering constant, regulated current. The switching device is a Metal Oxide Semiconductor Field Effect Transistor (MOSFET) capable of handling the required current and drain to source voltages with adequate safety margins and derated design. In some embodiments, it incorporates a suitable transformer for full isolation. In other embodiments, it is directly driven from rectified mains power. The design has necessary components to provide enough power and to provide regulated current in a step-down switch mode topology. In some embodiments, active current dividing circuitry is used to balance the current delivered to the LED arrays 28 when multiple LED arrays are used. An exemplary embodiment is shown in FIG. 23.

In some embodiments, the support circuitry accomplishes EMI noise filtering 55 and dampens filter ringing 60 at some applicable operational levels. The noise filter 55 is constructed of passive components providing noise suppression to meet applicable regulatory standards. Components are placed in the main power input lines, after the voltage is rectified. The dampening mechanisms 60, 75 for this filter embody both active elements and passive elements optimized to minimize losses. All filters are of either single or multiple pole design as required using differential or common mode inductors, RC snubbers and active devices. In some implementations, EMI noise filtering components are placed before voltage is rectified. In other implementations, EMI noise filtering components are placed after voltage rectification. In the sample embodiment shown in FIG. 22, the noise filtering is placed before a rectifier.

Another feature of some disclosed embodiments is bleeder circuitry, 80 and 65, which may achieve operational compatibility with current equipment design for conventional bulbs. A bleeder circuitry may serve to keep the current through the equipment's control device from falling below its minimum level. This improves flicker-free operation at different dimming levels. The bleeder circuit can be either active 80 or passive 65 and placed at a range of points in the circuit to achieve optimum results. A fan power supply 62 may be present in some embodiments and may contribute to bleeder circuitry functions.

In some embodiments, the assembly and overall power supply design 32 is self-contained, modular, and replaceable. It contains the circuit elements that the LED arrays and cooling elements may need to operate as expected. In some embodiments, an enclosure 14 protects the components and allows proper ventilation to the power dissipating parts. The assembly can allow for a field replacement of the power supply as a distinct assembly. In some implementations, this assembly may connect to the LED arrays 28 using an interface connector 34. In this fashion, the end user can remove and replace the power supply without disassembling other parts of the LED PAR.

In some embodiments, monitoring services data is collected 84 and the service data is transmitted via antenna 82 over open license radio spectrums. Some disclosed embodiments include a suitable radio frequency transceiver 83. In some embodiments, at regular intervals, a microcrontroller-based supervisory circuit uses broadcasts collected data at power levels within FCC compliance.

The light is emitted from commercially available LEDs in an array of elements 28 referred to as Chip on Board or COB systems. Embodiments include a singular element or multiple elements arranged in a pattern that accommodates other design features or packaging requirements. Light output, color temperature and the general quality of the light may determine the choice and number of elements in any suitable design.

Figure 10:
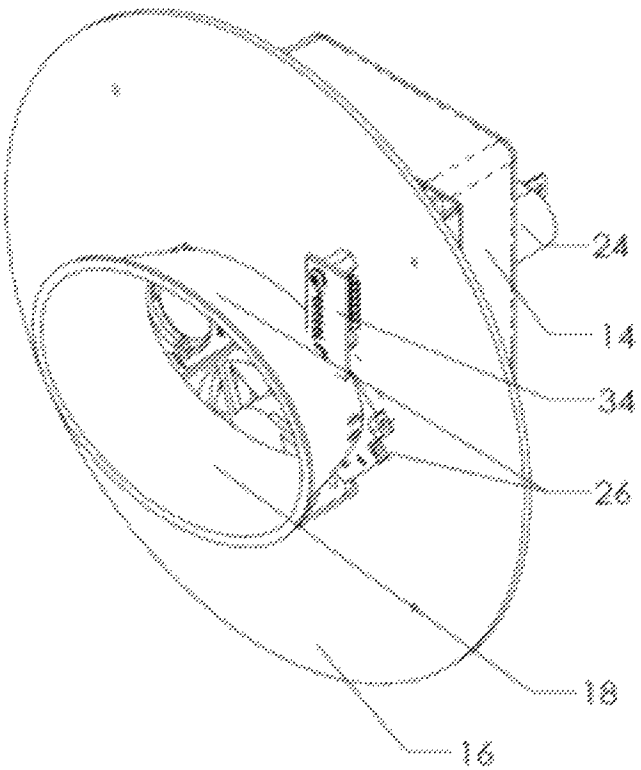
FIG. 10 is a perspective view of one embodiment of the present invention in a two LED, offset mounted fan arrangement with custom LED optics and a vented front cover shown both on and off for interior layout view.
Figure 10:
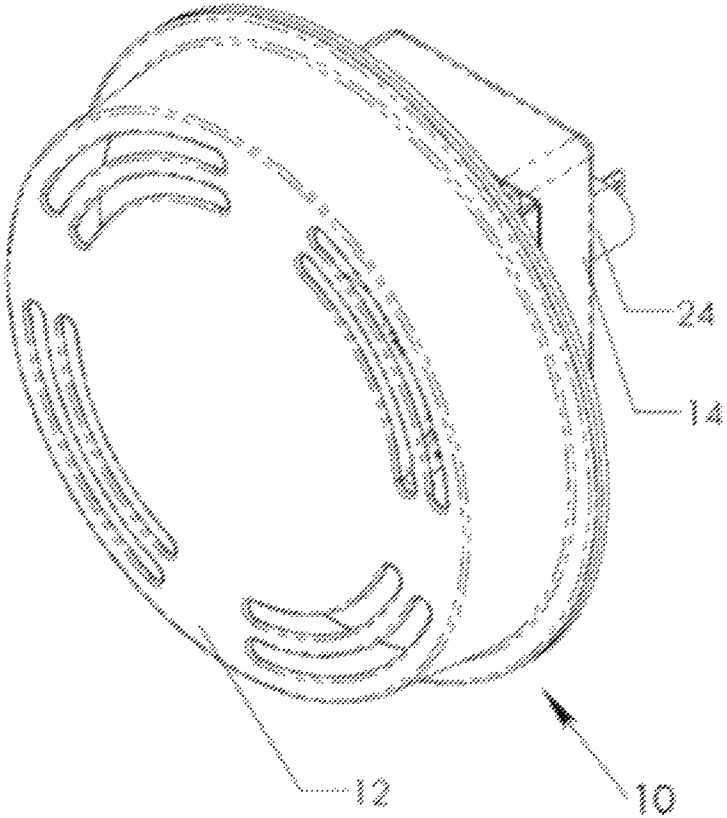
Figure 11:
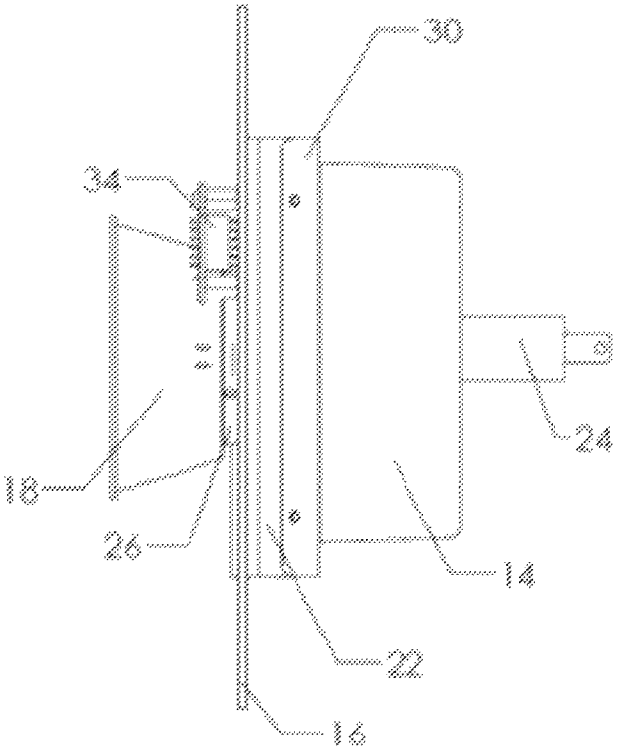
FIG. 11 is a front view and side view of the two LED, offset mounted fan layout, with custom LED optics and the front cover removed, in accordance with one embodiment.
Figure 11:
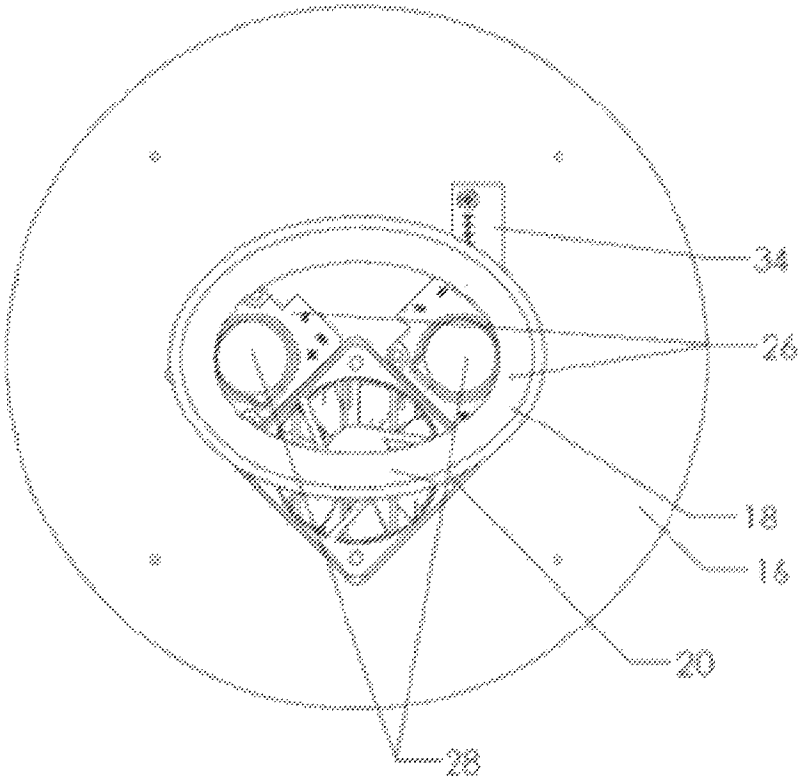
Figure 12:
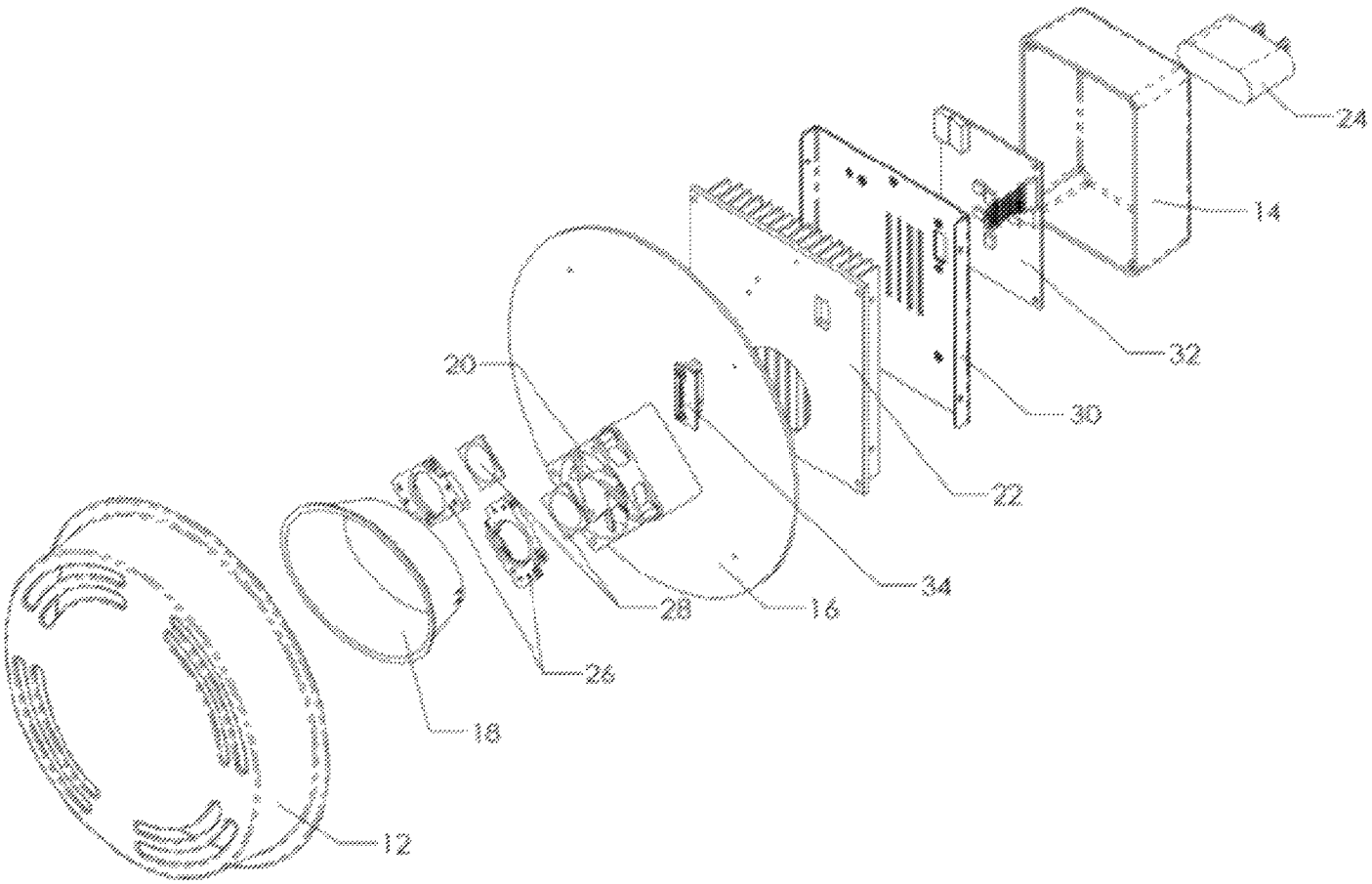
FIG. 12 is an exploded perspective view of the two LED, offset mounted fan layout with custom LED optics, in accordance with one embodiment.

In some embodiments, light pattern is controlled using optical elements 18 which may include reflectors, diffusers, collimators, and lenses of any variety or any custom combination thereof. In some embodiments, off the shelf parts are used to accomplish optical performance in some embodiments. In other embodiments, optical performance is achieved with custom designed and manufactured parts (e.g. 18 as shown in FIG. 10). A broad range of variations in the disclosed embodiments may produce light patterns similar to standard light beam spreads, for example, of narrow, narrow, medium flood and wide flood.

The construction details of the PAR LED include an embodiment of a multi-piece assembly or of any singular pieces that perform the same function as assembling separable parts. Any part or assembly may be a single piece that is cast, milled, forged, stamped or produced with a suitable a manufacturing method. It may be produced as an assembly of multiple parts that may also milled, forged, stamped or produced with a suitable manufacturing method.

The advantages of the disclosed embodiments can include, without limitation, the ability to replace widely manufactured conventional bulbs intended for a wide range of lighting applications. Reductions in energy use and longer service lifetimes over the conventional bulbs can be benefits of the LED PAR. Additional benefits can include better light control and reducing or eliminating damage to filter gels used. A general design feature of some embodiments of the LED PAR is such that fixtures into which it is installed require fewer modifications, alterations or additional parts for full functionality.

FIGS. 21-25 are diagrams of example embodiments of power supply schematics. These power supply schematics may be implemented in the power supply system shown in FIG. 20.

Figure 21:
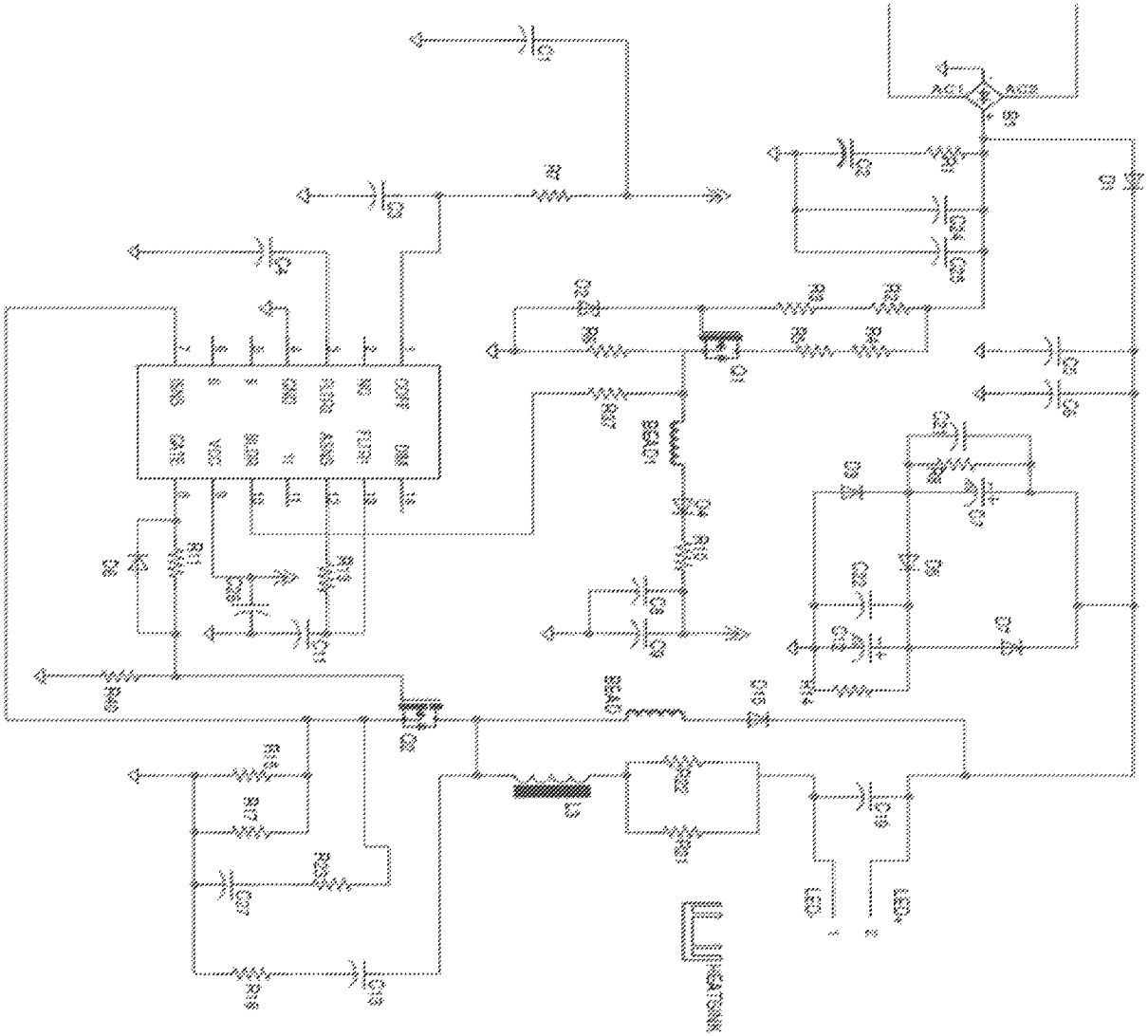
FIGS. 21-25 are diagrams of example embodiments of power supply schematics.

FIG. 21 illustrates an example constant current power supply. As shown in FIG. 21, a constant current is delivered to the LED module from an off-line switch mode buck converter. The controller sets the LED current level accord to the conduction angle, or 'on-time' of the power switching device in the dimmer.

Figure 22:
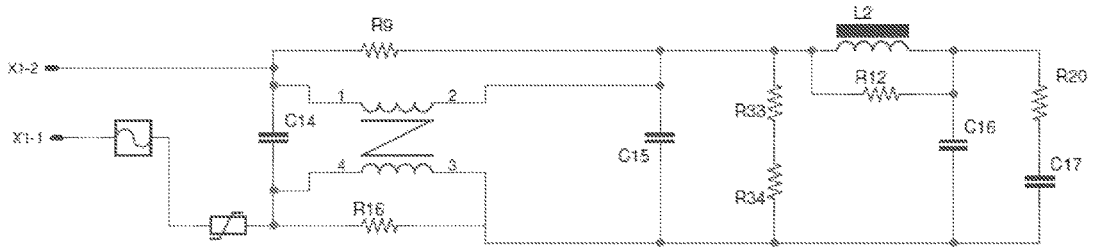

FIG. 22 illustrates an example EMI input filter. As shown in FIG. 22, the EMI input filter suppresses conducted electromagnetic noise, both common mode and differential, to acceptable levels for compliance with FCC Part 15 as a Class A device. There are two 'LC' filters in series and a 'RC' network to reduce ringing.

FIG. 23 illustrates an example multi-LED current divider. As shown in FIG. 23, current through multiple LED elements is balanced with current mirrors that include a transistor-diode network providing failsafe against an open LED condition; the present figure is a two LED embodiment.

Figure 24:
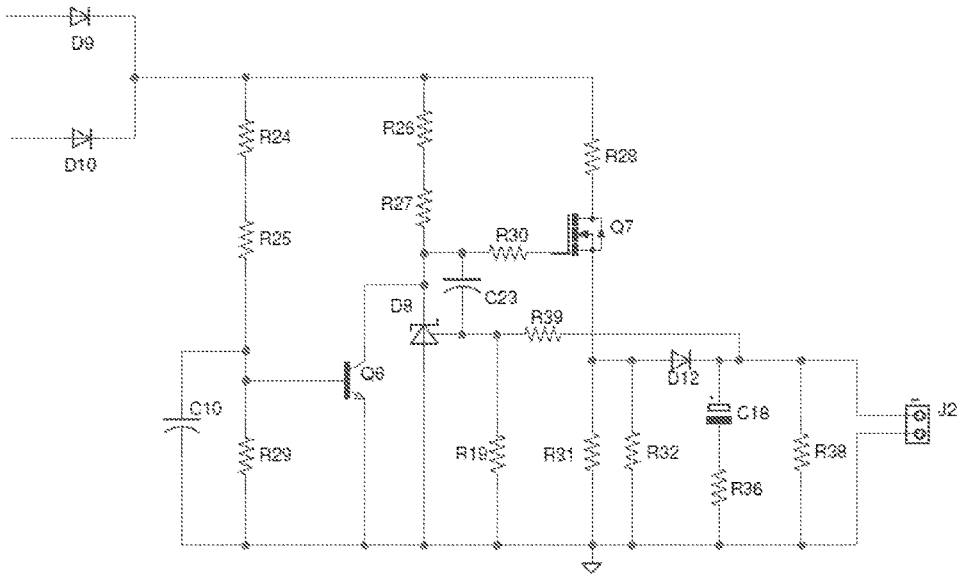

FIG. 24 illustrates an example fan power supply with bleeder circuit. As shown in FIG. 24, power is delivered to the fan through a linear regulator comprised of a precision diode with feedback. At high mains voltage levels in the AC cycle, the circuit is disabled to reduce dissipation in the pass transistor. In some embodiments, the fan power supply bleeder circuit components are placed before voltage is rectified. In other embodiments, the fan power supply bleeder circuit components can be placed after voltage rectification. In the sample embodiment shown in FIG. 24, the power supply bleeder circuit is before rectifier.

Figure 25:
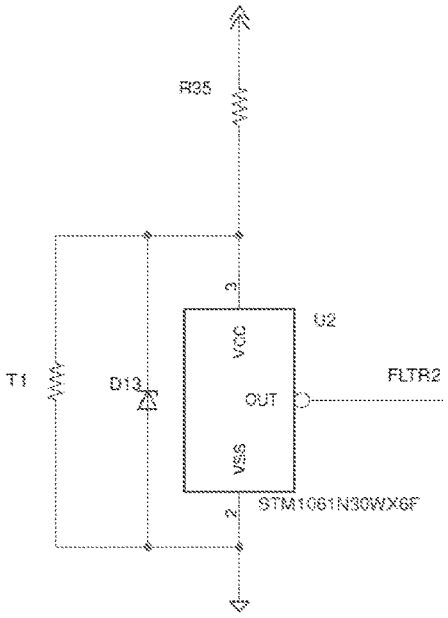

FIG. 25 illustrates an example thermal cutoff. As shown in FIG. 25, a thermal cutoff utilizes a voltage detector and thermistor to monitor PCB temperature and disable the buck converter if the temperature exceeds operational limits.

The above detailed description does not limit the LED PAR invention in scope of use, components used or any design element thereof. The embodiments do not limit this invention in the manner in which it is manufactured, assembled or produced. There is no limitation implied in specific components used in the electronic circuit as described. It should not be construed to be limited in any way as to its use in any compatible lighting fixture.

What is claimed is:

1. A device, comprising:

a cone-shape LED optics mounted on a circular-shape LED holder which is mounted on a first side of a circular-shape mounting plate;

the circular-shape mounting plate having a stripe-shape opening;

an interface connector board assembly providing power to the cone-shape LED optics;

a cuboid-shape heat sink mounted to a second side of the circular-shape mounting plate;

a heat sink shroud covering one or more faces of the cuboid-shape heat sink;

a power supply circuit board assembly for providing power to the interface connector board assembly;

an active cooling element mounted to the heat sink shroud;

a rear enclosure covering the power supply circuit board assembly; and a fixture connector plug mounted to the rear enclosure and connecting the power supply circuit board assembly with a power source.

2. The device of claim 1, wherein the first side and the second side are opposite sides of the mounting plate.

3. The device of claim 1, wherein at least a portion of the heat sink is directly cooled by the active cooling element through an opening of the mounting plate.

4. The device of claim 1, wherein the device includes a single LED optics.

5. The device of claim 1, wherein the circular-shape LED holder is mounted on at center of the mounting plate.

6. The device of claim 1, wherein the power supply circuit board assembly provides power to the cone-shape LED optics and to the active cooling element.

7. The device of claim 1, further comprising a data transmission component for transmitting usage data of the device to a computing device.

8. The device of claim 1, wherein the heat sink shroud covers a plurality of faces of the cuboid-shape heat sink.

9. The device of claim 1, further comprising a front cover covering the cone-shape LED optics and the circular-shape LED holder, the front cover including one or more curve-shape ventilation openings.

10. The device of claim 1, wherein the device further comprises a bleeder circuitry that is capable of causing the cone-shape LED optics to be dimmed.

11. The device of claim 10, wherein the dimming occurs using pulse-width modulation.

12. The device of claim 10, wherein the dimming occurs using constant current reduction.

13. The device of claim 9, wherein the front cover has a circular shape and covers the mounting plate.

14. The device of claim 1, wherein the active cooling element and the rear enclosure are mounted to two non-overlapping portions of the heat sink shroud.

15. The device of claim 1, wherein the rear enclosure does not cover the active cooling element.

16. The device of claim 1, further comprising an optical element for controlling lighting patterns of the LED optics.

17. The device of claim 1, wherein the mounting plate includes plastics.

18. The device of claim 17, wherein the mounting plate has a diameter of 7 or 8 inches.

19. The device of claim 1, wherein the stripe-shape opening is located on a top side of the mounting plate and the active cooling element is located on a bottom side of the mounting plate to provide air circulation between the top side and the bottom side.

20. The device of claim 1, wherein neither the cone-shape LED optics nor the mounting plate is covered.

21. The device of claim 1, wherein the rear enclosure includes a plurality of openings exposing the power supply circuit board assembly to allow air circulation.

* * * * *